US007548045B2

(12) United States Patent
Rizzo

(10) Patent No.: US 7,548,045 B2
(45) Date of Patent: Jun. 16, 2009

(54) LOW-CONSUMPTION VOLTAGE REGULATOR

(75) Inventor: Alessandro Rizzo, Savoca (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 177 days.

(21) Appl. No.: 11/617,424

(22) Filed: Dec. 28, 2006

(65) Prior Publication Data

US 2007/0170986 A1 Jul. 26, 2007

(30) Foreign Application Priority Data

Dec. 28, 2005 (IT) ..... MI2005A2500

(51) Int. Cl.
*G05F 1/575* (2006.01)
*H03F 3/20* (2006.01)

(52) U.S. Cl. ..... 323/280; 330/257

(58) Field of Classification Search ..... 323/273, 323/274, 275, 279, 280, 281, 303
See application file for complete search history.

(56) References Cited

U.S. PATENT DOCUMENTS 5,337,008 A * 8/1994 Badyal ..... 330/253
5,412,309 A * 5/1995 Ueunten ..... 323/316
6,867,572 B1 * 3/2005 Lin ..... 323/273
6,922,099 B2 * 7/2005 Shor et al. ..... 327/543

* cited by examiner

*Primary Examiner*—Gary L Laxton
(74) *Attorney, Agent, or Firm*—Lisa K. Jorgenson; E. Russell Tarleton; Seed IP Law Group PLLC

(57) ABSTRACT

A voltage regulator having an input voltage and adapted to supply a regulated output voltage, the regulator including an AB class amplifier and a power transistor having a non-drivable terminal coupled to the input voltage, a non-drivable terminal coupled to a reference voltage and a drivable terminal coupled to the output terminal of the amplifier; the amplifier is adapted to amplify the voltage difference between a further reference voltage and a fraction of the regulated voltage.

17 Claims, 5 Drawing Sheets

LOW-CONSUMPTION VOLTAGE REGULATOR

BACKGROUND OF THE INVENTION

1. Field of the Invention

The present disclosure pertains to a low-consumption voltage regulator.

2. Description of the Related Art

Linear voltage regulators of the ULDO (Ultra Low Drop Out) type are known in the state of the art. ULDO regulators are widely used in portable applications, in motorcars and in medical applications. These applications are fed by batteries that require low stand-by currents to increase the lifespan and the efficiency of the battery.

The efficiency of the regulator clashes with its time specifications. Indeed, a higher feeding current determines a faster response of the regulator. This is due to the charging and discharging of parasitic capacitances connected to the driving terminal of the power transistors of the voltage regulator, with parasitic capacitances on the order of hundreds of picofarads. Therefore, if the output load is varied, considerable current peaks are required by the voltage regulator to charge and discharge the parasitic capacitances in the shortest possible time.

A voltage regulator of the ULDO type is described in the article "A Low-Voltage, Low Quiescent Current, Low Drop-Out Regulator" by Gabriel A. Rincon-Mora and Philip E. Allen, IEEE Journal of Solid State Circuit, vol. 33, No. 1, January 1998, and is shown in FIG. 1. The regulator in FIG. 1 is a class A error operational amplifier 1 having on the inverting input a reference voltage Vref and on the non-inverting input a fraction Vr of the regulator output voltage Vout with Vr=(R2/(R1+R2))*Vout. The amplifier is fed by a voltage Vin and its output is connected to a buffer stage 2 comprising an NPN common collector bipolar transistor Q1, a MOS transistor mirror M1-M2 connected between the emitter terminal of transistor Q1 and the drain terminal of a transistor M3 having the source terminal connected to voltage Vin and the gate terminal connected to the emitter terminal of transistor Q1 and to the gate terminal of power transistor Mp. The latter has the source terminal connected to voltage Vin and the drain terminal connected to the series of resistors R1 and R2 connected to ground. A polarization current generator Ibias is connected to the gate and drain terminals of transistor M2.

Buffer stage 2 allows to release the parasitic capacitance Cpar of the power transistor Mp from the output terminal of error amplifier 1 but introduces in the regulator loop gain a third pole which complicates the compensation of the regulator. By recovering a fraction Iboost of output current Iload a certain stability of the system is guaranteed; in this case, indeed, the pole formed by the introduction of buffer stage 2 may be preferably shifted over the cut-off frequency of the open-loop gain of the regulator. Benefits may also be obtained in the response time of the regulator by appropriately dimensioning current Iboost.

However, if the current in load Iload has a low value, the corresponding fraction of current Iboost becomes very small and practically null; in such a case, no benefit derives in terms of response in time.

BRIEF SUMMARY OF THE INVENTION

The embodiments disclosed herein provide a low-consumption voltage regulator that overcomes the aforesaid drawback.

According to one embodiment, a voltage regulator having an input voltage is adapted to supply a regulated output voltage, the regulator including an amplifier and a power transistor having a non-drivable terminal coupled to the input voltage, a non-drivable terminal coupled to a reference voltage, and a drivable terminal coupled to the output terminal of the amplifier, the amplifier adapted to amplify the difference of voltage between a further reference voltage and a fraction of the regulated voltage, wherein the amplifier is an AB class amplifier.

In accordance with another embodiment, a circuit is provided that includes an AB class operational amplifier having an inverting input, a non-inverting input, an output, and a non-drivable input coupled to an input voltage; a power transistor having a gate terminal coupled to the output terminal of the operational amplifier, a source terminal coupled to the input voltage, and a drain terminal coupled to an output terminal of the regulator; a voltage divider having an input coupled to the drain terminal of the power transistor and an output coupled to the non-inverting input of the AB class amplifier; and the inverting input of the AB class amplifier coupled to a first reference voltage, the AB class amplifier adapted to amplify a voltage difference between the further reference voltage and the output of the voltage divider.

In accordance with another aspect of the foregoing embodiment, the circuit includes the output of the voltage regulator is coupled to a load. Ideally, the circuit also includes a first amplifier cell and a second amplifier cell, each amplifier cell including a differential pair of transistors having a pair of input terminals connected in phase opposition, and each amplifier cell including an output terminal coupled to a common terminal of the respective differential pair of transistors.

In accordance with another embodiment of the invention, a power transistor having a source terminal coupled to a voltage input, a drain terminal coupled to an output terminal, and a control terminal; a voltage divider having a first terminal coupled to the source terminal of the power transistor, a second terminal coupled to a ground reference potential, and an output terminal; and an AB class amplifier having an output coupled to the control terminal of the power transistor, a non-drivable terminal coupled to the input voltage, a non-inverting input coupled to the output terminal of the voltage divider, and an inverting input coupled to a reference voltage source, the AB class amplifier including a cascode mirror, a first amplifier cell including a first differential pair, a second amplifier cell including a second differential pair, and each amplifier cell including an output coupled to the cascode mirror and to a drivable terminal of a respective further transistor, the AB class amplifier adapted to amplify a voltage difference between the reference voltage and the output of the voltage divider.

BRIEF DESCRIPTION OF THE SEVERAL VIEWS OF THE DRAWINGS

The features and advantages of the embodiments disclosed herein will be more apparent in the following description of a practical embodiment thereof shown by way of non-limitative example in the accompanying drawings, in which.

DETAILED DESCRIPTION OF THE INVENTION

Figure 2:
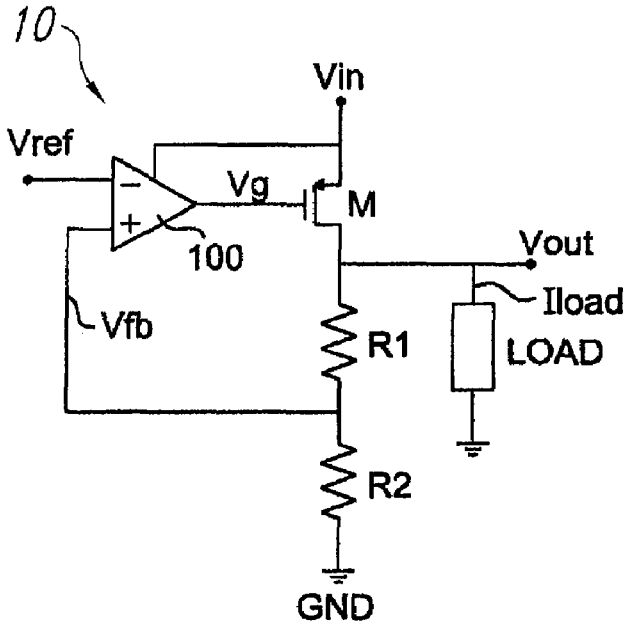
FIG. 2 is a diagram of a voltage regulator according to the present disclosure.

FIG. 2 shows one embodiment of a voltage regulator 10 according to the present disclosure. The regulator includes an error operational amplifier 100 having the inverting input connected to a reference voltage Vref and output terminal Vg coupled, but preferably directly connected, to the gate terminal of a MOS power transistor M having the source terminal connected to voltage Vin and the drain terminal connected in series to two resistors R1 and R2 connected to ground GND. The voltage on the drain terminal of transistor M is the regulator output voltage Vout, while voltage Vfb given by the resistive divider of the two resistors R1 and R2, Vfb=(R2/(R1+R2))*Vout, is received on the non-inverting input of the amplifier 100. Voltage Vout is also the voltage at the terminals of a load LOAD in which a current Iload flows. Amplifier 100 is an AB class amplifier, i.e., an amplifier in which there is energy consumption only when input voltages Vref and Vfb are not the same.

Figure 1:
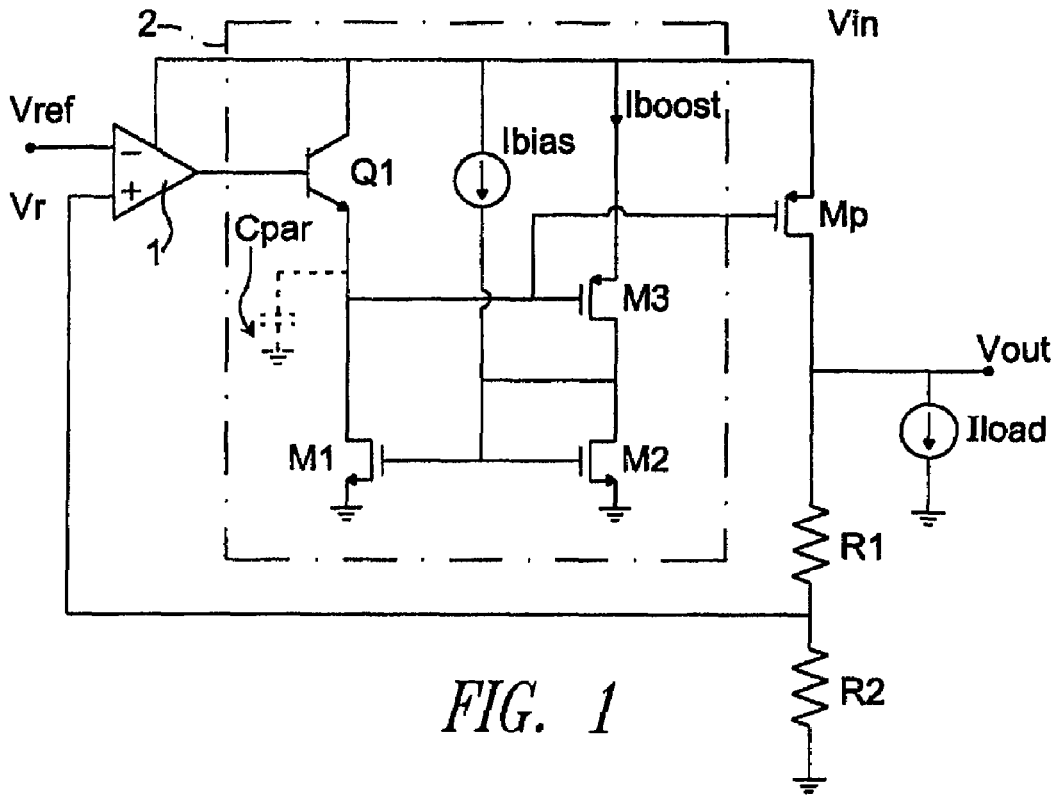
FIG. 1 is a diagram of a voltage regulator according to the known art.

The use of an AB class amplifier renders the use of the voltage buffer superfluous, as in the regulator of FIG. 1. Furthermore, the regulator of FIG. 2 only has two poles, and this enhances frequency compensation to improve stability; furthermore, the circuit configuration of the regulator 10 provides a faster response in time.

Figure 3:
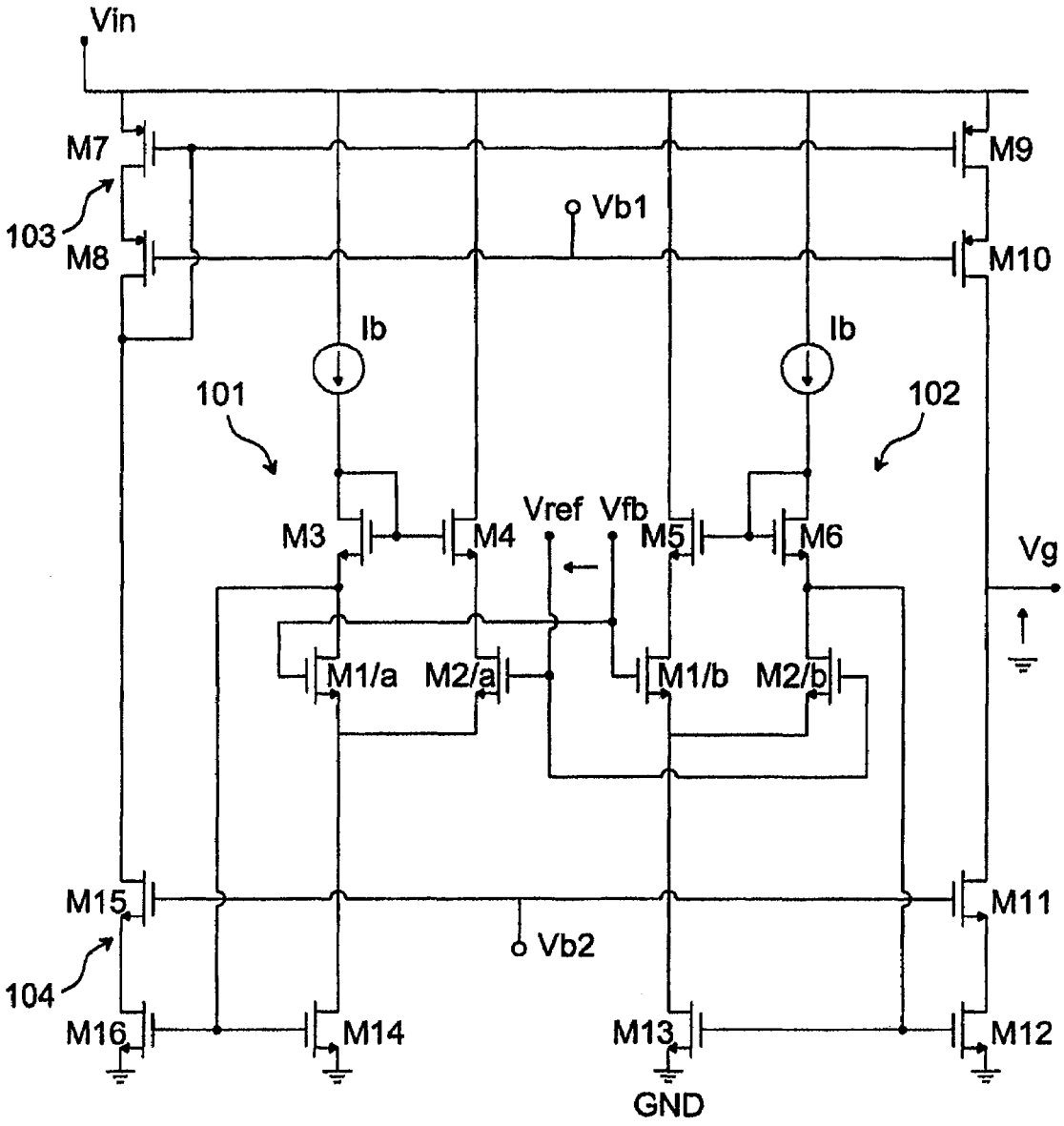
FIG. 3 is a diagram of the error amplifier of the regulator in FIG. 2 according to an embodiment of the present disclosure.

An AB class type amplifier usable in the voltage regulator 10 according to one embodiment is described in FIG. 3. The amplifier 100 includes two AB class cells 101 and 102 having input terminals reciprocally connected in phase opposition and the corresponding outputs of which are reciprocally connected by means of a high-dynamic cascode current mirror 103.

Cell 101 has a differential pair of MOS transistors M1/*a*, M2/*a*, the drain terminals of which are connected to a simple current mirror M3, M4 adapted to minimize the channel modulation effect of the differential pair M1/*a*, M2/*a*, and the gate terminals of which are respectively connected to voltages Vfb and Vref.

Cell 102 comprises a differential pair of MOS transistors M1/*b*, M2/*b*, the drain terminals of which are connected to a simple current mirror M5, M6 adapted to minimize the channel modulation effect of the differential pair M1/*b*, M2/*b*, and the gate terminals of which are connected respectively to voltages Vfb and Vref.

The drain terminals of the transistors M3, M4 and M5, M6 of cells 101 and 102 are connected to the input voltage Vin, while the source terminals of the transistors M1/*a*, M2/*a* and M1/*b*, M2/*b* are connected to the drain terminals of the transistors M14 and M13 belonging to a circuit structure 104 adapted to supply the outputs of differential pairs M1/*a*, M2/*a* and M1/*b*, M2/*b* to cascode current mirror 103.

The circuit structure 104 includes a first circuit part formed by transistors M14-M16 and adapted to supply the output of differential stage M1/*a*, M2/*a* to a current mirror 103 and a second circuit part formed by transistors M11-M13 and adapted to supply the output of differential stage M1/*b*, M2/*b* to the same current mirror 103. In the first circuit part, the transistor M16 has a gate terminal in common with the gate terminal of transistor M14, and with the drain terminal of transistor M1/*a* and has the drain terminal connected to the source terminal of transistor M15. The latter has the drain terminal connected to the cascode mirror 103 and the gate terminal connected to a polarization voltage Vb2, with for example Vb2=1V; the source terminals of transistors M14 and M16 are connected to ground GND. In the second circuit part, transistor M12 has the gate terminal in common with the gate terminal of transistor M13 and with the drain terminal of transistor M2/*b*, and it has the drain terminal connected to the source terminal of transistor M11. The latter has the drain terminal connected to the cascode mirror 103 and the gate terminal connected to a polarization voltage Vb2; the source terminals of transistors M13 and M12 are connected to ground GND.

The current mirror 103 is formed by transistors M7-M10, and the gate terminals of transistors M10 and M8 are connected to a polarization voltage Vb1, with for example Vb1=Vin−1V. The current mirror 103 is connected to the voltage Vin, as are mirrors M3, M4 and M5, M6. Current Ib is a polarization current.

The output voltage Vg at cascode mirror 103 is the driving voltage of the gate terminal of transistor M of the regulator in FIG. 2.

The cells 101 and 102 have an AB class operation when the voltage Vfb is different from voltage Vref and in virtue of the negative feedback loops obtained by means of the electrical connection of the drain terminal of transistor M1/*a* to the gate terminal of transistor M14 and with the electrical connection of the drain terminal of transistor M2/*b* to the gate terminal of transistor M13.

Figure 4:
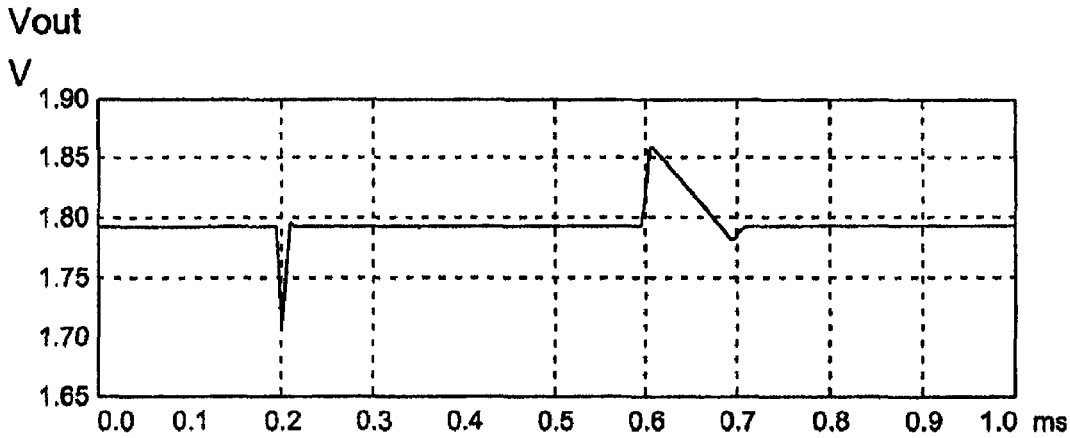
FIG. 4 shows a voltage and current diagram on the load of the regulator in FIG. 2 in certain conditions of operation.
Figure 4:
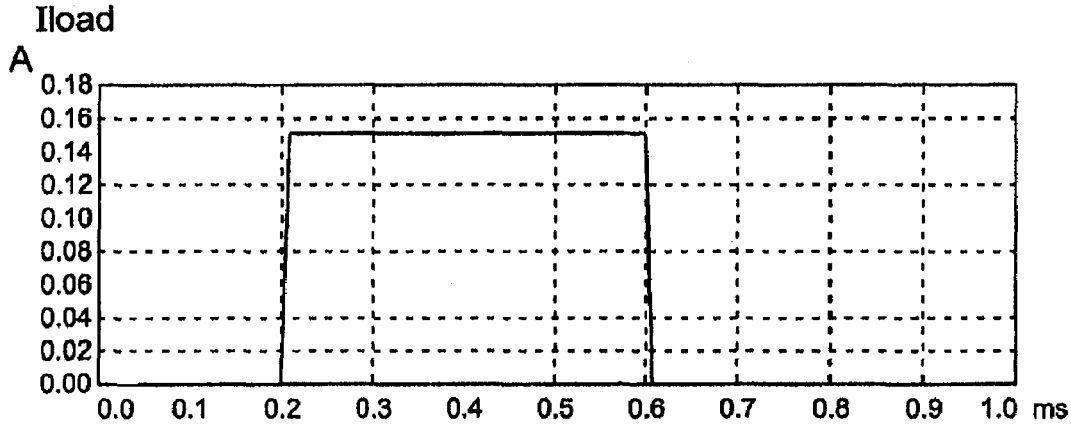

FIG. 4 shows a time diagram of the current Iload on the load and a time diagram of output voltage Vout of the regulator in FIG. 2 (with the use as amplifier 100 of the amplifier in FIG. 3) when the current Iload on the load is varied from a value of 1 mA to a value of 150 mA and vice versa in a period of time of a few microseconds. The variation is detected by the regulator which will attempt to take output voltage Vout to its nominal value in the shortest possible time; the response time is calculated as the time needed by the regulator to return imbalanced voltage Vout to its nominal value.

In the diagram in FIG. 4, the regulator in accordance with the invention is fed with a voltage Vin=2.8 Volt and by programming a nominal voltage of Vout of 1.8 Volt; a time response of 0.4 ms (4 microseconds) is obtained.

Figure 5:
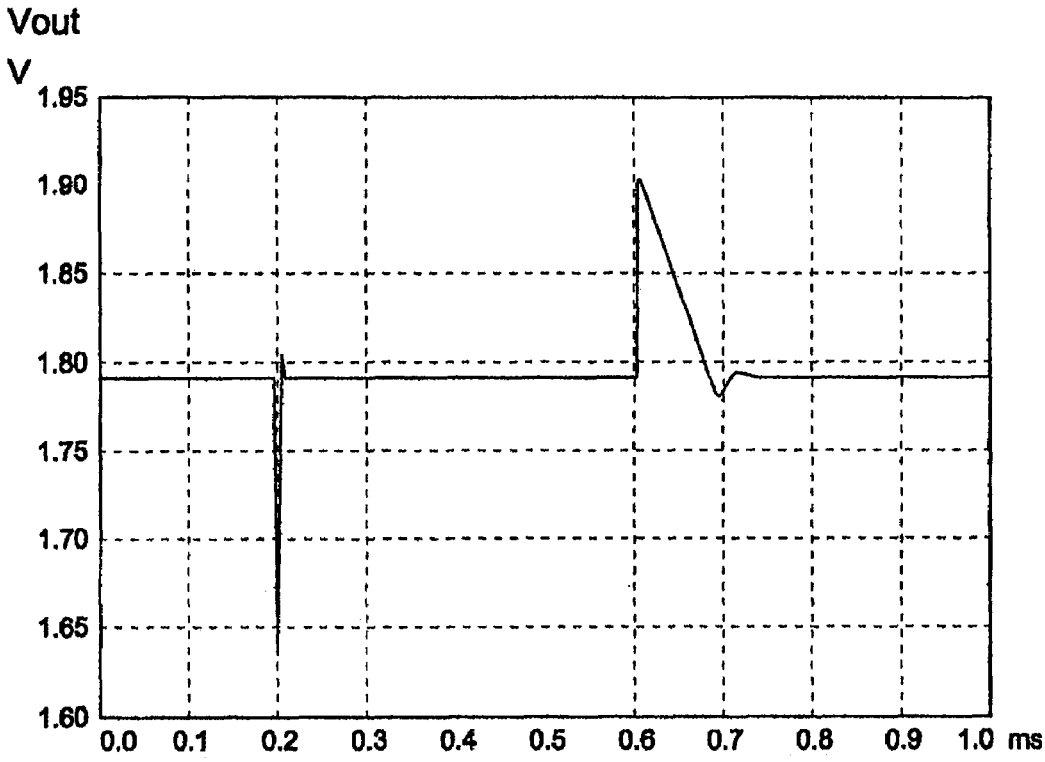
FIGS. 5 and 6 show time diagrams of the voltage output by the regulator in FIG. 2 in other conditions of operation.

FIG. 5 shows a time diagram of output voltage Vout of the regulator in FIG. 2 with the use as amplifier 100 of the amplifier in FIG. 3 (when current Iload on the load is varied from a value of 1 mA to a value of 150 mA and vice versa in a period of time of a few microseconds), with a different voltage value Vin, Vin=2.0 Volt. The regulator is in drop conditions, i.e., the condition in which the regulator can still regulate the input voltage Vin; normally the drop value is fixed with Vin=Vout+0.2V.

Figure 6:
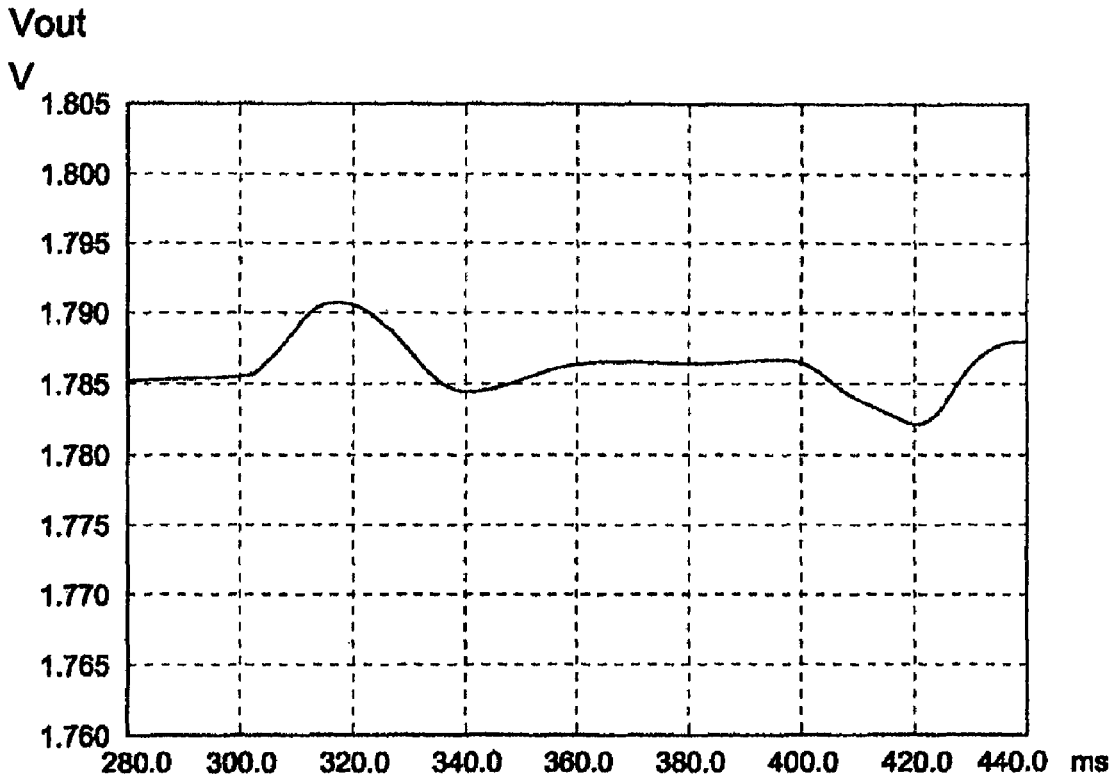

FIG. 6 shows the time chart of output voltage Vout of the regulator in FIG. 2, using as amplifier 100 the amplifier in FIG. 3, when voltage Vin is varied from an initial value of 2.3 V to a value of 3.1 V and vice versa in a period of time of one microsecond with a load current Iload=1 mA. The variation is detected by the regulator which will attempt to take the output voltage Vout to its nominal value in the shortest possible time; the response time is calculated as the time needed by the regulator to return unbalanced voltage Vout to its nominal value.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A voltage regulator having an input voltage and adapted to supply a regulated voltage output, the regulator comprising:

an AB class amplifier comprising two AB class cells each comprising a pair of input terminals connected in phase opposition; and a power transistor having a first non-drivable terminal coupled to the input voltage, a second non-drivable terminal coupled to a reference voltage, and a drivable terminal coupled to the output terminal of the amplifier, the amplifier adapted to amplify a voltage difference between a further reference voltage and a fraction of the regulated voltage.

2. The regulator of claim 1 wherein the two AB class cells each comprise an output terminal, the amplifier comprising a cascode mirror adapted to connect the outputs of the two AB class cells and to supply the regulated voltage.

3. The regulator of claim 1 wherein each of the two AB class cells comprise a differential pair of transistors, the drivable terminals of which represent the input terminals of the cell, the output terminal of each cell coupled to a common terminal of the differential pair of transistors.

4. The regulator of claim 3 wherein the output terminal of each AB class cell is connected to the drivable terminal of a further transistor having a non-drivable terminal connected to the common terminal of the differential pair.

5. A circuit, comprising:

an AB class operational amplifier having an inverting input, a non-inverting input, an output, and a non-drivable input coupled to an input voltage, the AB class operational amplifier comprising a first AB amplifier cell and a second AB amplifier cell;

a power transistor having a gate terminal coupled to the output terminal of the operational amplifier, a source terminal coupled to the input voltage, and a drain terminal coupled to an output terminal of the regulator;

a voltage divider having an input coupled to the drain terminal of the power transistor and an output coupled to the non-inverting input of the AB class amplifier; and the inverting input of the AB class amplifier coupled to a first reference voltage, the AB class amplifier adapted to amplify a voltage difference between the further reference voltage and the output of the voltage divider.

6. The circuit of claim 5 wherein the output of the voltage regulator is coupled to a load.

7. The circuit of claim 5 wherein each amplifier cell comprising a differential pair of transistors having a pair of input terminals connected in phase opposition, and each amplifier cell comprising an output terminal coupled to a common terminal of the respective differential pair of transistors.

8. The circuit of claim 7 wherein the output terminal of each amplifier cell is connected to the drivable terminal of a respective further transistor, each further transistor having a non-drivable terminal connected to the common terminal of the differential pair.

9. A voltage regulator circuit, comprising:

a power transistor having a source terminal coupled to a voltage input, a drain terminal coupled to an output terminal, and a control terminal;

a voltage divider having a first terminal coupled to the source terminal of the power transistor, a second terminal coupled to a ground reference potential, and an output terminal; and an AB class amplifier having an output coupled to the control terminal of the power transistor, a non-drivable terminal coupled to the input voltage, a non-inverting input coupled to the output terminal of the voltage divider, and an inverting input coupled to a reference voltage source, the AB class amplifier comprising a cascode mirror, a first amplifier cell comprising a first differential pair, a second amplifier cell comprising a second differential pair, and each amplifier cell comprising an output coupled to the cascode mirror and to a drivable terminal of a respective further transistor, the AB class amplifier adapted to amplify a voltage difference between the reference voltage and the output of the voltage divider.

10. The circuit of claim 9 wherein the voltage divider comprises a first resistor and a second resistor coupled in series with the output of the voltage divider taken from the node between the first and second resistors.

11. The circuit of claim 10 wherein the first and second further transistors each have a non-drivable terminal coupled to a common terminal of the differential pair of transistors of each amplifier cell.

12. The circuit of claim 11 wherein each differential pair of MOS transistors has drain terminals coupled to a current mirror and gate terminals coupled respectively to the reference voltage and the output voltage of the voltage divider.

13. The circuit of claim 12 wherein drain terminals of the current mirror are coupled to the voltage input.

14. A voltage regulator having an input voltage and adapted to supply a regulated voltage output, the regulator comprising:

an AB class amplifier comprising two AB cells each comprising a pair of input terminals connected in phase opposition, each of the two AB class cells comprising a differential pair of transistors, the drivable terminals of which represent the input terminals of the cell, the output terminal each cell coupled to a common terminal of the differential pair of transistors, and the output terminal of each AB cell is connected to the drivable terminal of a farther transistor having a non-drivable terminal connected to the common terminal of the differential pair; and a power transistor having a first non-drivable terminal coupled to the input voltage, a second non-drivable terminal coupled to a reference voltage, and a drivable terminal coupled to the output terminal of the amplifier, the amplifier adapted to amplify a voltage difference between a further reference voltage and a fraction of the regulated voltage.

15. The regulator of claim 14 wherein the two AB class cells each comprise an output terminal, the amplifier comprising a cascode mirror adapted to connect the outputs of the two AB class cells and to supply the regulated voltage.

16. A circuit, comprising:

an AB class operational amplifier having an inverting input, a non-inverting input, an output, and a non-drivable input coupled to an input voltage, the AB class operational amplifier comprising a first AB amplifier cell and a second AB amplifier cell, each AB amplifier cell comprising a differential pair of transistors having a pair of input terminals connected in phase opposition, and each amplifier cell comprising an output terminal coupled to a common terminal of the respective differential pair of transistors, the output of each AB amplifier cell connected to the drivable terminal of a respective further transistor, each farther transistor having a non-drivable terminal connected to the common terminal of the differential pair;

a power transistor having a gate terminal coupled to the output terminal of the operational amplifier, a source terminal coupled to the input voltage, and a drain terminal;

a voltage divider having an input coupled to the drain terminal of the power transistor and an output coupled to the non-inverting input of the AB class amplifier; and the inverting input of the AB class amplifier coupled to a first reference voltage, the AB class amplifier adapted to amplify a voltage difference between the further reference voltage and the output of the voltage divider.

17. The circuit of claim 16 wherein the output of the voltage regulator is coupled to a load.

* * * * *